US006505584B2

(12) United States Patent
Lou

(10) Patent No.: US 6,505,584 B2
(45) Date of Patent: Jan. 14, 2003

(54) VARIABLE ENGINE VALVE CONTROL SYSTEM

(75) Inventor: Zheng Lou, Plymouth, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/742,200

(22) Filed: Dec. 20, 2000

(65) Prior Publication Data

US 2002/0108591 A1 Aug. 15, 2002

(51) Int. Cl.[7] ..... F01L 9/02
(52) U.S. Cl. ..... 123/90.12; 91/170
(58) Field of Search ..... 74/472; 91/170; 123/90.12, 568; 137/625.18

(56) References Cited

U.S. PATENT DOCUMENTS

| | | | | |
|---|---|---|---|---|
| 2,398,997 A | * | 4/1946 | Berry et al. | 74/472 |
| 2,658,484 A | | 11/1953 | Kenny | |
| 2,831,464 A | | 4/1958 | Lillquist | |
| 3,156,157 A | | 11/1964 | Smith et al. | |
| 4,000,756 A | | 1/1977 | Ule et al. | |
| 4,106,586 A | | 8/1978 | Stafford | |
| 4,186,649 A | * | 2/1980 | Sundstrom | 91/170 |
| 4,450,928 A | | 5/1984 | Weber et al. | |
| 4,930,464 A | | 6/1990 | Letsche | |
| 5,275,136 A | | 1/1994 | Schechter et al. | |
| 5,287,829 A | * | 2/1994 | Rose | 123/90.12 |
| 5,451,029 A | | 9/1995 | Krüger | |
| 5,572,961 A | | 11/1996 | Schechter et al. | |
| 5,603,305 A | * | 2/1997 | Miyake et al. | 123/568 |
| 5,713,315 A | | 2/1998 | Jyoutaki et al. | |
| 6,170,524 B1 | * | 1/2001 | Gray, Jr. | 137/625.18 |

FOREIGN PATENT DOCUMENTS

| | | |
|---|---|---|
| DE | 3833-459 | 4/1990 |
| GB | 982003 | 6/1965 |
| JP | 59-180142 | 10/1984 |
| JP | 61-109905 | 5/1986 |

OTHER PUBLICATIONS

U.S. Application for Variable Engine Valve Control System: filed Dec. 20, 2000, Lou, Z.

* cited by examiner

*Primary Examiner*—Thomas Denion
(74) *Attorney, Agent, or Firm*—Brinks Hofer Gilson & Lione

(57) ABSTRACT

A discrete lift, variable timing (DLVT) engine valve control system for an internal combustion engine includes a plurality of electrohydraulic valves. The plurality of electrohydraulic valves are operable between at least an open and closed position. Each of the plurality of electrohydraulic valves is operable independently of the other of the plurality of electrohydraulic valves. In one preferred embodiment, a selected combination of the plurality of electrohydraulic valves are selectively operated between at least the open and closed positions to move a selected combination of a plurality of pistons disposed in a selected combination of a plurality of axially spaced cylinders positioned serially one on top of the other. In an alternative preferred embodiment, a selected combination of the plurality of electrohydraulic valves are selectively operated between at least the open and closed positions to open a selected combination of longitudinally spaced exhaust ports communicating with a cylinder. Methods for controlling an engine valve in an internal combustion engine also are provided.

32 Claims, 7 Drawing Sheets

CONTROL SCHEME C1B:
PISTON MOVEMENTS AND HYDRAULIC FORCE IN OPENING MOTION

VARIABLE ENGINE VALVE CONTROL SYSTEM

BACKGROUND

The present invention relates generally to a variable engine valve control system, and in particular, to a discrete lift, variable timing engine valve control system.

In general, various throttle-less systems can be used to actively control engine valves through the use of variable lift and/or variable timing so as to achieve various improvements in engine performance, fuel economy, reduced emissions, and other like aspects. Typically, such systems are mechanical VVLT (variable valve-lift and timing), electrohydraulic VVLT, or electro/mechanical VVT (variable valve-timing). In general, mechanical VVLT systems are cam-based systems, which may have additional phasers, cams and linkage. One important limitation of such mechanical VVLT systems is that the timing and lift variations are not independent. Electro/mechanical VVT systems generally replace the cam in the mechanical VVLT system with an electro-mechanical actuator. However, such systems do not provide for variable lift.

In contrast, an electrohydraulic VVLT system is controlled by electrohydraulic valves, and can generally achieve independent timing and lift controls so as to thereby provide greater control capability and power density. However, typical electrohydraulic VVLT systems are generally rather complex, can be expensive to manufacture, and typically are not as reliable or robust as mechanical systems due to their relative complexity.

BRIEF SUMMARY

Briefly stated, in one aspect of the invention, one preferred embodiment of a valve control system for an internal combustion engine includes a housing comprising a plurality of fixed, axially spaced cylinders positioned serially one on top of the other with each of the plurality of cylinders defining a stroke respectively. The plurality of cylinders comprises a lowermost cylinder and at least one next upper cylinder, wherein the stroke of the at least one next upper cylinder is less than or equal to the stroke of a next lower cylinder. A plurality of pistons includes a lowermost piston disposed in the lowermost cylinder and at least one next upper piston disposed respectively in the at least one next upper cylinder. Each of the at least one next upper pistons engages a next lower piston during the stroke of the at least one next upper piston respectively. An engine valve is connected to the lowermost piston. A plurality of electrohydraulic valves are operable between at least an open and closed position. Each of the plurality of electrohydraulic valves is operably connected to one of the plurality of cylinders and is operable independently of the other of the plurality of electrohydraulic valves. A selected combination of the plurality of electrohydraulic valves are selectively operated between at least the open and closed positions.

In an alternative preferred embodiment of the invention, the valve control system includes a housing comprising a cylinder having a longitudinal extent and a plurality of longitudinally spaced exhaust ports communicating with the cylinder. A piston is disposed in the cylinder and is moveable therein along the longitudinal extent. An engine valve is connected to the piston. A plurality of electrohydraulic valves are operable between at least an open and closed position. Each of the plurality of valves is operably connected to one of the plurality of exhaust ports and is operable independently of the other of said plurality of electrohydraulic valves. A selected combination of the plurality of electrohydraulic valves are selectively operated between at least the open and closed positions.

In another aspect of the invention, a method for controlling an engine valve in an internal combustion engine is provided. The method includes activating a combination of the plurality of electrohydraulic valves, moving a combination of the plurality of pistons through a plurality of corresponding strokes, engaging a next lower piston with a next upper piston, disengaging the next lower piston from the next upper piston as the stroke of the next upper piston is completed and moving the engine valve in response to moving the combination of the plurality of pistons.

In yet another aspect of the invention, the method includes activating a combination of the plurality of electrohydraulic valves and opening a combination of said plurality of exhaust ports, moving the piston in a first direction, successively covering the combination of the plurality of exhaust valves with the piston as the piston moves in the first direction, and moving the engine valve in the first direction in response to moving the piston in the first direction.

The present inventions provide significant advantages over other valve control systems, and methods for controlling valve engines. For example, each of the present embodiments of the valve control system is configured as an electrohydraulic DLVT (discrete lift, variable timing) system, which achieves discrete lift and variable timing for engine valves. By employing a discrete lift control, relatively simple hydraulic valves can be used, which eliminates the need for position sensing and feedback controls in the system and thereby substantially reduces the complexity and cost of the system. In this way, a system employing discrete lift control is simpler, less expensive and more robust than an electrohydraulic VVLT system, when used in most applications. In addition, by providing a plurality of discrete lifts, the system can closely match the performance of the VVLT system under most operating conditions.

DETAILED DESCRIPTION OF THE PRESENTLY PREFERRED EMBODIMENTS

As used herein, the term "discrete" means "controlled in steps," i.e., not infinitely variable. The term "variable" as used herein means "infinitely" variable or adjustable. The term "longitudinal" as used herein means of or relating to length or the lengthwise dimension. The term "plurality" as used herein means two or more.

The terms "top," "bottom," "upper," "lower," "lowermost," and "uppermost" as used herein are intended to indicate the various directions or positions of, or various components within, the housing and cylinders relative to the position of the engine valve, regardless of the orientation of the housing and cylinders, and are not to be interpreted as requiring any component to have a specific orientation along a vertical axis. Rather, one of skill in the art should understand that the housing, cylinders and pistons can be oriented in any direction, including a horizontal and vertical orientation, with the engine valve located at a top, bottom, or opposite side thereof, with the terms "bottom" or "lower" simply meaning that the designated component is closer to the engine valve than a similar component designated as "top" or "upper."

Figure 1:
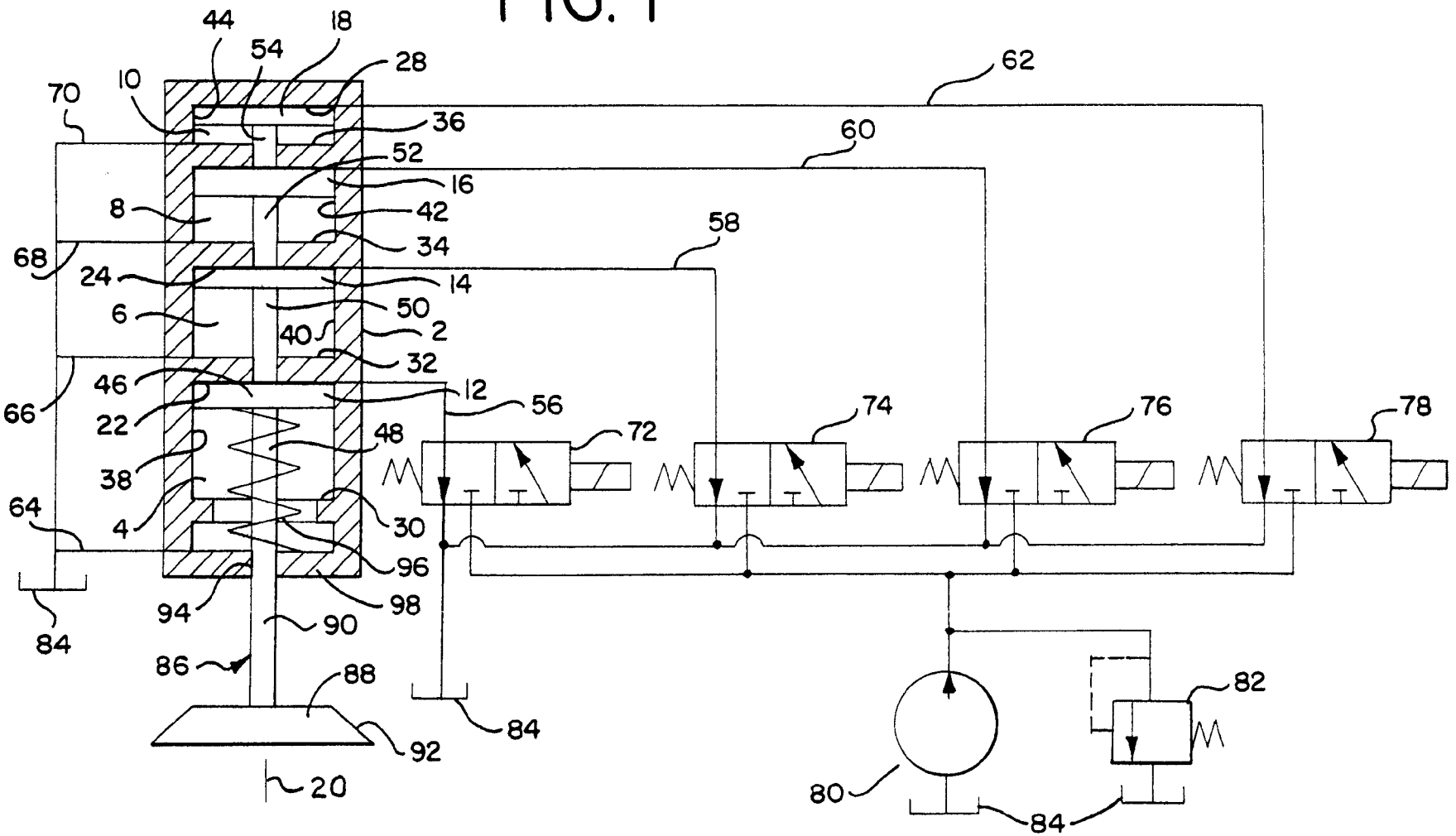
FIG. 1 is a schematic illustration of a first embodiment of an engine valve control system.

A variety of different embodiments of the DLVT system are shown in the attached drawings. Referring to FIG. 1, in a first embodiment, a multi-cylinder spring return (MCSR) DLVT system includes a housing 2 defining a plurality of cylinders, shown as a first, second, third and fourth cylinder 4, 6, 8, 10. In a preferred embodiment, the housing comprises an engine cylinder head. A plurality of pistons, shown as a first, second, third and fourth piston 12, 14, 16, 18 are disposed respectively in the cylinders. The cylinders 4, 6, 8, 10 are axially spaced along longitudinal axis 20. Each cylinder 4, 6, 8, 10 is defined by a top 22, 24, 26, 28, a bottom 30, 32, 34, 36 and a sidewall 38, 40, 42, 44. Preferably, the top and bottom of each cylinder are fixed, or non-moveable relative to one another. The distance each piston 12, 14, 16, 18 moves within each cylinder 4, 6, 8, 10 between the top and bottom thereof is defined as the stroke of the cylinder. The strokes of the first, second, third, and fourth cylinder are designated S1, S2 and S3, and S4, respectively. For the purposes of illustration, the strokes are defined respectively as: S1=4 mm, S2=3 mm, S3=2 mm, and S4=1 mm. Therefore, in this exemplary embodiment, the stroke of the first cylinder 4 is greater than the stroke of the next upper second cylinder 6, which is greater than the stroke of the next upper third cylinder 6, which is greater than the stroke of the next upper fourth cylinder 8. For proper operation, the stroke of each next upper cylinder is preferably less than or equal to the stroke of a next lower cylinder, and more preferably less than the stroke of the next lower cylinder.

Each piston 12, 14, 16, 18 includes a piston head 46 and a push rod 48, 50, 52, 54. The piston push rods of each cylinder extend through the bottom of the cylinder into the next lower cylinder and engage the top of the next lower piston head. As such, the push rods become progressively shorter as they are correlated with the stroke of their respective pistons. The volumetric displacement of each piston equals the stroke multiplied by the bore area (A), or the cross-sectional area, of the piston head. Preferably, the pistons 12, 14, 16, 18 have the same nominal cross-sectional area "A." Of course, it should be understood that the cross-sectional areas of the respective pistons can be different, e.g., with the area of one or more of the pistons being different from the areas of the other pistons. The linear displacement of the first, second, third and fourth pistons are designated as X1, X2, X3 and X4, respectively. The linear displacements X1, X2, X3 and X4 do not exceed the strokes S1, S2, S3 and S4 of the cylinders, respectively.

It should be understood that the valve control system requires at least two cylinders and pistons having different strokes for discrete lift, but that any number of additional cylinders and pistons can be selected and incorporated into the system based on performance requirements and cost considerations. For example, additional cylinders and pistons can be used to provide the system with additional discrete lift options. As such, the exemplary embodiment of four cylinders and pistons is meant only to be illustrative, rather than limiting.

Each cylinder 4, 6, 8, 10 is connected to a hydraulic circuit, which includes a first, second, third and fourth inlet line 56, 58, 60, 62 communicating with a top portion of the first, second, third and fourth cylinders respectively. First, second, third and fourth exhaust lines 64, 66, 68, 70 communicate with a bottom of the first, second, third and fourth cylinders respectively, and are connected to an exhaust tank 84. A plurality of electrohydraulic valves, shown as a first, second, third and fourth electrohydraulic valve 72, 74, 76, 78, operably connect the first, second, third and fourth inlet lines 56, 58, 60, 62, and their respective cylinders, to a hydraulic pump 80, which is further connected to a pressure regulating valve 82, e.g., a pressure relieve valve. The pump can be configured as a variable-displacement pump for efficiency. It should be understood that other pumps would also work, including for example, servo-controlled pumps with pressure regulating mechanisms. Each of the electrohydraulic valves 72, 74, 76, 78 is preferably configured as a three-way, two-position, normally-off, on/off solenoid valve, which is exhausted to a tank 84. It should be understood that other valves, including for example three-way, two-position, normally-on (open), on/off solenoid valves can also be used. The electrohydraulic valves are operable between at least an open and closed position. In the preferred embodiment, the solenoid is energized to an "ON" (open) position. The timing of the valve control system is variably controlled by varying the timing of the activation of the solenoid valves. One of skill in the art may alternatively combine two or more simple valves into an integrated or complex valve. The design of the valves depends on the requirements in flow, speed, pressure, durability, sealing, cost, package, etc. A seated valve, for example, is generally better in sealing and cost than a spool valve.

As shown in FIG. 1, an engine valve 86, preferably configured as a poppet valve, includes a head 88 and a stem 90, which is connected to the push rod 48 of the first, or lowermost, piston 12. The face 92 of the valve is angled and mates with a valve seat (not shown) formed on the housing 2. The stem 90 is guided by a valve guide 94 formed in the housing. The engine valve lift is defined as the distance the engine valve 86 is raised off its seat as it moves in a first direction, and is designated by Lev. The engine valve head 88 is seated as it moves in a second direction opposite the first direction and contacts the valve seat.

The valve control system has various control schemes and resulting discrete engine valve lifts. Importantly, each of the electrohydraulic valves is operable independently of the other electrohydraulic valves, meaning that any selected combination of the plurality of valves can be activated or energized to the open or "ON" position. The term "combination" means one or more of the plurality, and can include the entire plurality.

In operation, a desired, selected combination (one or more) of electrohydraulic valves are activated such that hydraulic fluid is directed through a corresponding selected combination of inlet lines and into a corresponding selected combination of cylinders and applies a force to a corresponding selected combination of pistons. Assuming that "A" is the same for each of the plurality of pistons, the force applied to each piston is designated as Fo=A*Ps, where Ps is the nominal hydraulic system pressure exerted by the pump. The total hydraulic force applied to the engine valve is designated as Fhyd. Initially, the force Fhyd applied to the engine valve is equal to the sum of the forces applied to each piston within the selected combination of pistons. In particular, the push rod of an individual next upper piston engages the piston head of an adjacent next lower piston, with the lowermost first piston 12 being connected to the engine valve 86. As the selected combination of pistons, and any pistons positioned below the uppermost piston within the selected combination engaged thereby, are displaced, hydraulic fluid is allowed to exit through a respective exhaust port to the exhaust tank 84.

As the pistons are displaced by the force Fhyd, the uppermost piston, with its push rod, eventually successively disengages from the next lower piston head as the uppermost piston is fully displaced. At that time, the force Fhyd applied to the engine valve is reduced by the Fo applied to the uppermost piston. It should be understood that any pistons within the plurality of pistons positioned above the uppermost piston of the selected combination will not be displaced during this sequence of operation, since it is not acted upon by a hydraulic force, or by a next upper piston or any combination of next upper pistons. Conversely, a piston positioned beneath the uppermost piston of the selected combination will be displaced as it is acted upon by the selected pistons of the combination located thereabove, even if such as piston is not part of the selected combination. However, as soon as any pistons within the selected combination located above the unselected piston are completely displaced, the unselected piston will not be further displaced. Eventually, each of the selected pistons within the selected combination are fully displaced.

The lift Lev of the engine valve equals the displacement of the piston located in the cylinder having the largest stroke within the selected combination. The engine valve is initially accelerated a greater amount when acted upon by more than one piston within a selected combination. As the pistons within the combination become fully displaced, the engine valve decelerates in response to the reduction in the force Fhyd.

In the reverse operation, to move the engine valve in the second direction toward the valve seat, the solenoids are deenergized, or turned "OFF" (closed), such that a return mechanism can return the engine valve to the valve seat. As shown in FIG. 1, the return mechanism comprises a spring 96 acting between a bottom wall 98 of the housing and a bottom of the first piston head 46. A backup force Fob is applied to each of the pistons being moved in the second direction, wherein Fob=A*Pb, with Pb being the back-up pressure, which is either created by flow resistance or by an additional valve (not shown) in the return circuit. Generally, the backup pressure Pb is much smaller than the nominal hydraulic system pressure Ps. As each next upper piston is engaged by the next lower piston, an additional Fob is applied to the next upper piston and to the engine valve. Accordingly, the engine valve 86 is decelerated or slowed down as it is seated. For proper operation, the biasing force exerted by the return mechanism, shown as the spring 96, must be greater than the sum of the total backup forces Fob exerted on the entire plurality of pistons.

Various operating schemes are illustrated in the following Table 1:

TABLE 1

| Scheme | CO | C4 | C3A | C3B | C2A | C2B | C1A | C1B |
|---|---|---|---|---|---|---|---|---|
| | | | | Opening Sequence | | | | |
| Sol 1 | Off | Off | Off | Off | Off | Off | On | On |
| Sol 2 | Off | Off | Off | Off | On | On | Off | On |
| Sol 3 | Off | Off | On | On | Off | On | Off | On |
| Sol 4 | Off | On | Off | On | Off | On | Off | On |
| X1 | 0 | 1 | 2 | 2 | 3 | 3 | 4 | 4 |
| X2 | 0 | 1 | 2 | 2 | 3 | 3 | 0 | 3 |
| X3 | 0 | 1 | 2 | 2 | 0 | 2 | 0 | 2 |
| X4 | 0 | 1 | 0 | 1 | 0 | 1 | 0 | 1 |
| Lev | 0 | 1 | 2 | 2 | 3 | 3 | 4 | 4 |
| Fhyd | 0 | Fo | Fo | 2Fo> Fo | Fo | 3Fo> 2Fo> Fo | Fo | 4Fo> 3Fo> 2Fo> Fo |
| | | | | Closing Sequence | | | | |
| Sol 1 | Off | Off | Off | Off | Off | Off | Off | Off |
| Sol 2 | Off | Off | Off | Off | Off | Off | Off | Off |
| Sol 3 | Off | Off | Off | Off | Off | Off | Off | Off |
| Sol 4 | Off | Off | Off | Off | Off | Off | Off | Off |
| X1 | 0 | 0 | 0 | 0 | 0 | 0 | 0 | 0 |
| X2 | 0 | 0 | 0 | 0 | 0 | 0 | 0 | 0 |
| X3 | 0 | 0 | 0 | 0 | 0 | 0 | 0 | 0 |
| X4 | 0 | 0 | 0 | 0 | 0 | 0 | 0 | 0 |
| Lev | 0 | 0 | 0 | 0 | 0 | 0 | 0 | 0 |
| Fhyd | 0 | 4Fob | 3Fob | 3Fob> 4Fob | 2Fob | 2Fob> 3Fob> 4Fob | Fob | Fob> 2Fob> 3Fob> 4Fob |

Although not illustrated in the above table, it should be understood that other operating schemes can be achieved by selecting other combinations of electrohydraulic valves, including for example, selecting one or more of the following combinations: solenoid valves 72, 76 (Sol. 1, 3), solenoid valves 74, 78 (Sol. 2, 4), solenoid valves 72, 78 (Sol. 1, 4), solenoid valves 74, 76 (Sol. 2, 3), solenoid valves 72, 74, 76 (Sol. 1, 2, 3) and solenoid valves 72, 74 (Sol. 1, 2).

As shown in the table, the engine valve lift Lev can be discretely controlled to correspond to the largest displacement of the selected piston within the combination of pistons. In the exemplary embodiment, for example, the engine valve lift can be controlled at 1, 2, 3 and 4 mm by using control schemes C4, C3A (or C3B), C2A (or C2B), and C1A (or C1B), respectively. The differences between "A" and "B" sub-schemes of C3, C2 and C1 are the intermediate hydraulic forces on the engine valve, not the end position of, nor the end hydraulic force (Fo) applied to, the engine valve.

For example, in the C1A operating scheme, only the solenoid of the first electrohydraulic valve 72 is energized in the opening sequence. As such, the selected combination comprises a single electrohydraulic valve 72 and corresponding cylinder 4 and piston 12. The first piston 12 disposed in the first cylinder 4, and also the engine valve 86 connected thereto, move down 4 mm under hydraulic force Fo while the second, third and fourth pistons 8, 10, 12 remain stationary. In the closing sequence, the solenoid of the first electrohydraulic valve 72 is turned off, allowing the first piston 12 to be pushed back by the spring 96 against a backup hydraulic force of Fob.

Figure 2:
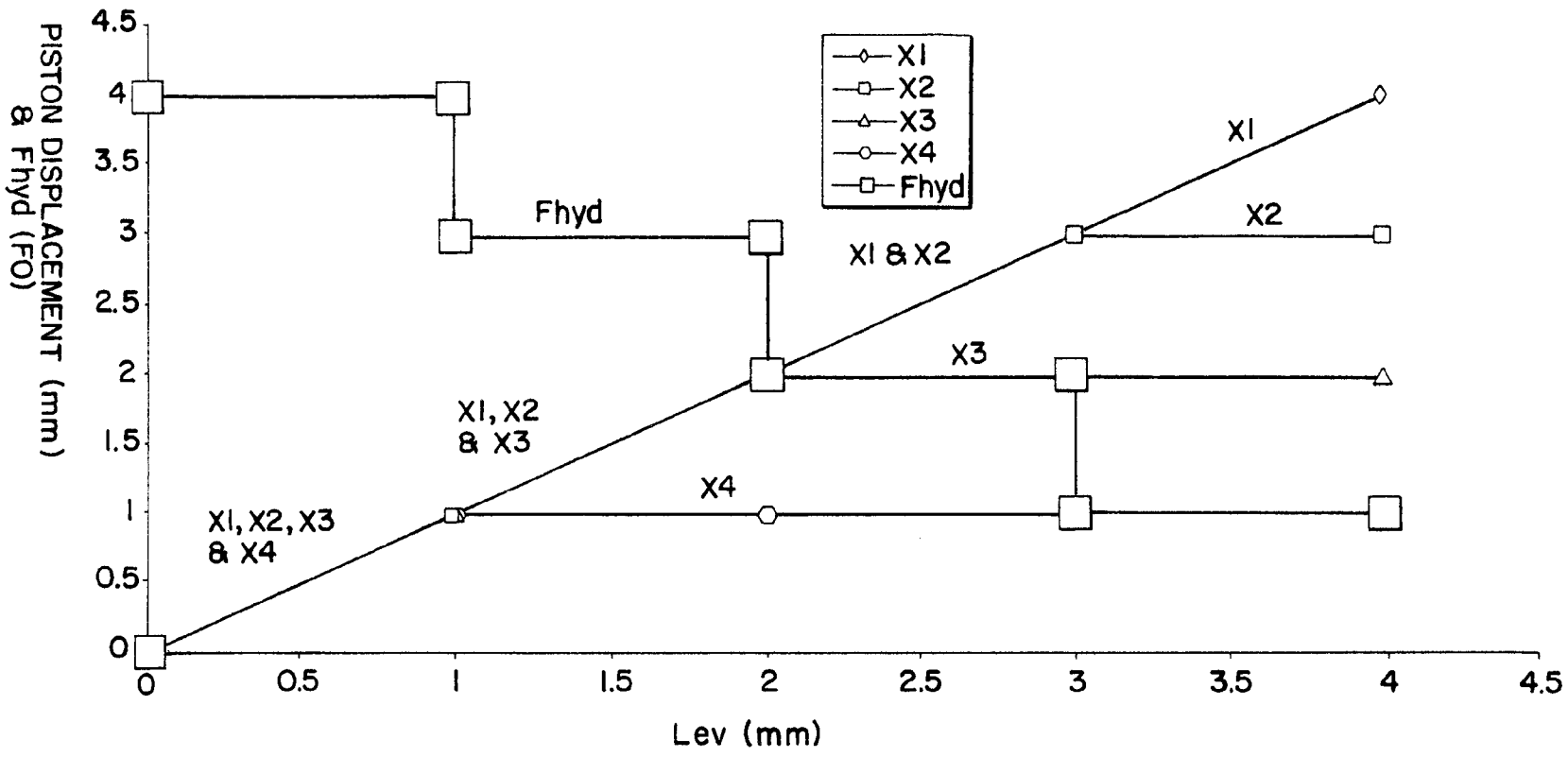
FIG. 2 is a graphical illustration of one control scheme for the engine valve control system of FIG. 1.

In the C1B operating scheme, the selected combination includes all four electrohydraulic valves 72, 74, 76, 78, pistons 12, 14, 16, 18 and cylinders 4, 6, 8, 10. In particular, all of the solenoid values 72, 74, 76, 78 are simultaneously energized in the opening sequence. As shown in FIG. 2, the first, second, third and fourth pistons 12, 14, 16, 18 all move down in a first direction initially under a total hydraulic force of 4Fo until the fourth piston 18 reaches its stroke of 1 mm. The first, second and third pistons 12, 14, 16 then continue their movement in the first direction under a total hydraulic force of 3Fo until the third piston 16 reaches its stroke of 2 mm. The first and second pistons 12, 14 then move further in the first direction under a total hydraulic force of 2Fo until the second piston 14 reaches its stroke of 3 mm. Finally, the first piston 12 finishes its final leg of movement in the first direction under a hydraulic force of Fo until it reaches its stroke of 4 mm and the engine valve achieves a total lift of 4 mm.

In the closing motion, the first piston moves in a second direction under the biasing force of the spring 96 and against the backup hydraulic force Fob until the engine valve opening is 3 mm. The first piston 12 then moves with the second piston 14 under the spring force and against the backup hydraulic force 2Fob until engine valve opening is 2 mm. The first and second pistons 12, 14 then move with the third piston 16 under the spring force and against the backup hydraulic force 3Fob until engine valve opening is 1 mm. Finally, the first, second and third pistons 12, 14, 16 then move with the fourth piston 18 under the spring force and against the backup hydraulic force 4Fob until the engine valve 88 is seated.

Relative to scheme C1A, scheme C1B offers faster movement of the engine valve 86 in the earlier phases of the opening sequence motion while decelerating and slowing so as to maintain a soft landing (with the piston 12 hitting the bottom 30) at the end of the stroke. During the closing sequence, scheme C1B again provides for progressively more resistance, which slows the engine valve 86, and thus provides for a softer landing during the seating process. Of course, scheme C1B requires action of additional electrohydraulic valves, including additional solenoids, and consumes more hydraulic energy. Similar comparisons can be made between schemes C2A and C2B and between schemes C3A and C3B.

Figure 3:
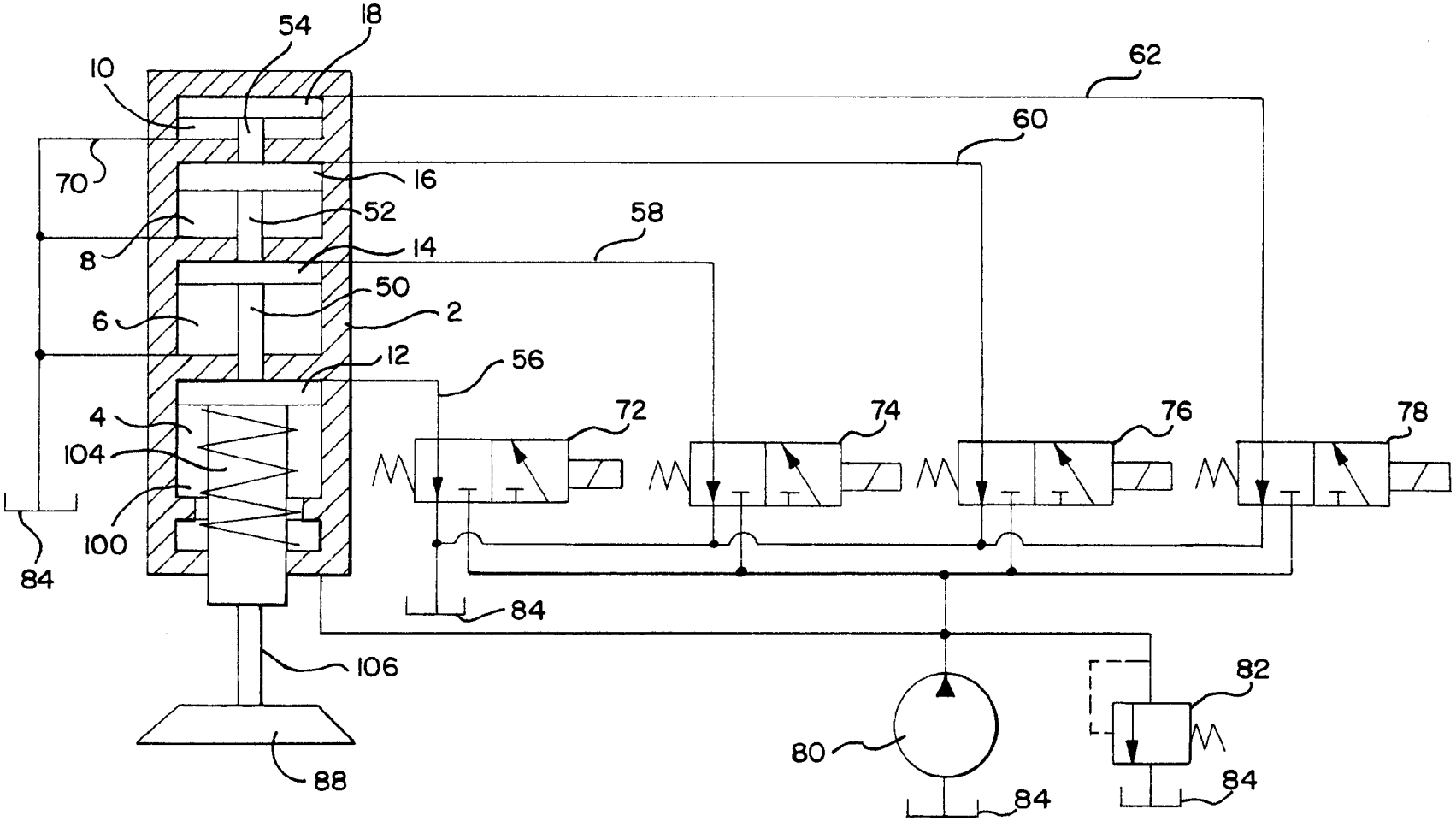
FIG. 3 is a schematic illustration of a second embodiment of an engine valve control system.

In a second alternative embodiment, shown in FIG. 3, a multi-cylinder hydraulic-return (MCHR) DLVT system includes a differential first cylinder 100 connected to a hydraulic pump 80, which is further connected to a pressure regulating valve 82, and a first piston having a push rod 104, with a substantial cross-section area, and an engine valve stem 106. It should be understood that the valve stem preferably has a relatively small or substantially smaller cross-sectional area than the push rod to reduce the inertia, although the cross-sectional area could be the same as that of the push rod, or could be some other cross-section area. The push rod side of the first piston 12 is pressurized for the return function, which is the only substantial difference from the first embodiment (MCSR) DLVT system shown in FIG. 1. An assist spring can also be provided to assist in the biasing function. The remaining components shown in FIG. 2 have been designated with the same reference numbers used to identify like components of the first embodiment shown in FIG. 1.

Figure 4:
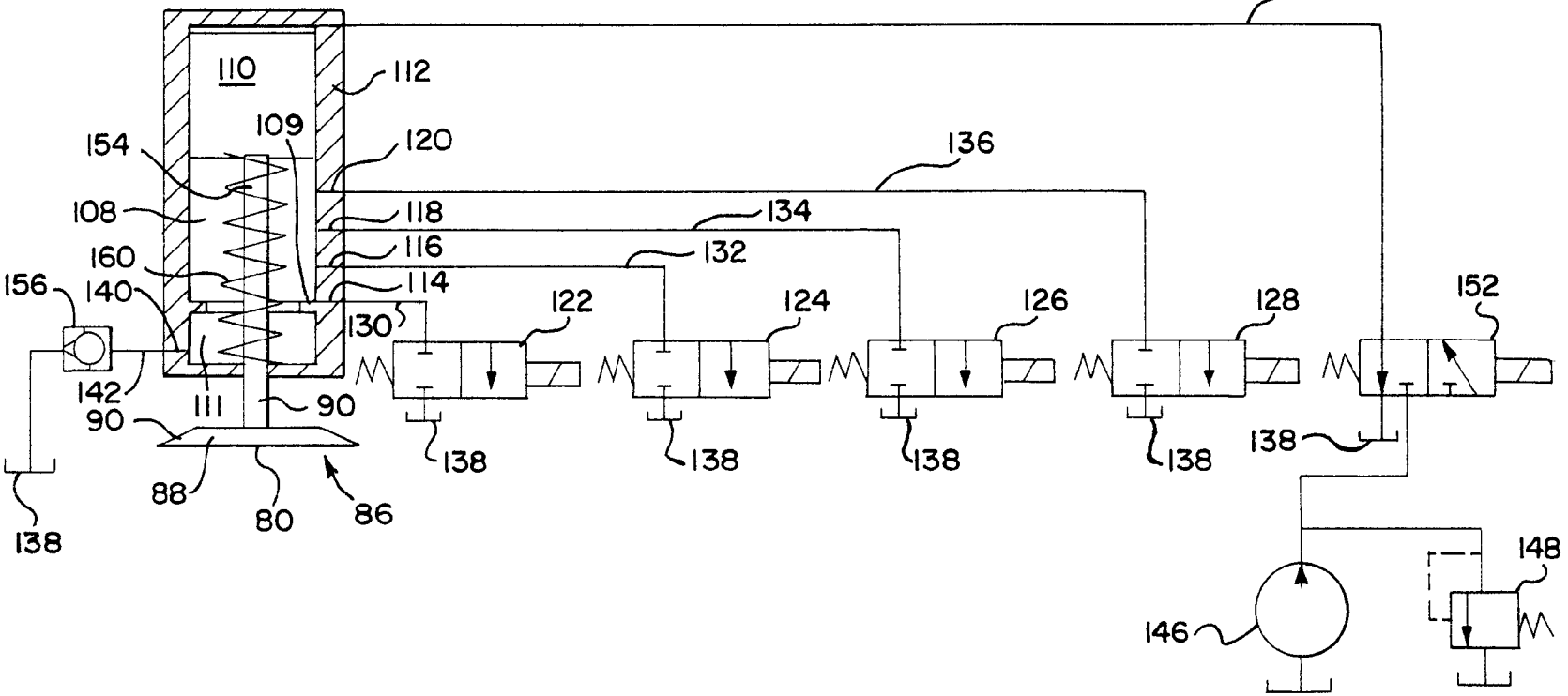
FIG. 4 is a schematic illustration of a third embodiment of an engine valve control system.

In a third alternative embodiment, shown in FIG. 4, a single-cylinder spring-return (SCSR) DLVT system includes a single cylinder 108 having a longitudinal extent and a single piston 110. A stop 109 is defines a bottom of the stroke of the piston 110, and forms a cavity 111 therebelow. A housing 112 includes a plurality of longitudinally spaced exhaust ports 114, 116, 118, 120 communicating with the cylinder 108. In an exemplary embodiment, first, second, third and fourth exhaust ports 114, 116, 118, 120 are provided, so as to provide for four discrete lift configurations. A plurality of electrohydraulic valves 122, 124, 126, 128, preferably configured as 2-way, 2-position solenoid valves, are operably connected to the exhaust ports 114, 116, 118, 120 with exhaust lines 130, 132, 134, 136 and empty into an exhaust tank 138. The plurality of electrohydraulic valves are independently operable. A pump 146, with an attached pressure regulator valve 148, is operably connected to a top portion of the cylinder with an inlet line 150 and an electrohydraulic valve 152. A one-way check valve 156 and tank 138 are connected to a bottom of the cylinder. Alternatively, the bottom is connected to a pressurized source (not shown) through the valve 156.

In operation, the electrohydraulic valve 152, preferably configured as a solenoid valve, is energized to flow hydraulic fluid into the cylinder 108 and thereby push the piston 110 and push rod 154 in a first direction to move the connected engine valve 86 toward an open position. At the same time, a selected combination of the electrohydraulic valves are selectively opened so as to allow fluid to be exhausted through a corresponding selected combination of exhaust ports.

For example, when the solenoid valve 152 is energized, the piston 110 will be pushed downward as long as one or more of the exhaust ports 114, 116, 118, 120 are open. If only the first exhaust port 114 is opened by energizing the first solenoid valve 122, the piston 110 will travel the full stroke. If only the fourth exhaust port 120 is opened by energizing the fourth solenoid valve 128, the piston 110 will travel until it covers the exhaust port 120 completely, resulting in a much shorter stroke. Intermediate strokes can be achieved by opening either of the remaining second and third exhaust ports 116, 118 with the second and third valves 124, 126.

If all four exhaust ports 114, 116, 118, 120 are opened by energizing all four solenoid valves 122, 124, 126, 128, the piston 110 will travel at a high speed initially with the back side being exhausted through the four exhaust ports. The piston will slow down as it successively covers the fourth, third and second exhaust ports 120, 118, 116. The travel speed reduction near the end of a stroke is also inherent in this design because of the gradual flow cross-section flow reduction as the piston 110 slides over the exhaust ports, resulting in a throttling effect. In addition to such exhaust port throttling, one of skill in the art can also design various hydraulic cushion mechanisms commonly used in hydraulic cylinders.

Because of the clearance between the piston and the housing or cylinder lining, there is always some leak along the piston, resulting in non-rigid stop. Within the time frame of an internal combustion engine cycle, the creeping motion caused by any leaking will be negligible.

During the closing sequence, the electrohydraulic valve 152 is deenergized and thereby allows fluid above the top of the piston 110 to flow back through line 150 into tank 138 as the piston is biased upwardly by a spring 160. The cylinder volume below the piston is back-filled by fluid from tank 138 through the check valve 156, line 142 and port 140. Alternatively, one or more of the electrohydraulic valves 122, 124, 126 and 128 can be opened or kept open to provide additional back-filling routes so as to thereby shorten the closing period. In another alternative, backfilling through port 140, line 142 and check valve 156 can be completely replaced by routing fluid through port 114, line 130 and valve 122.

Figure 5:
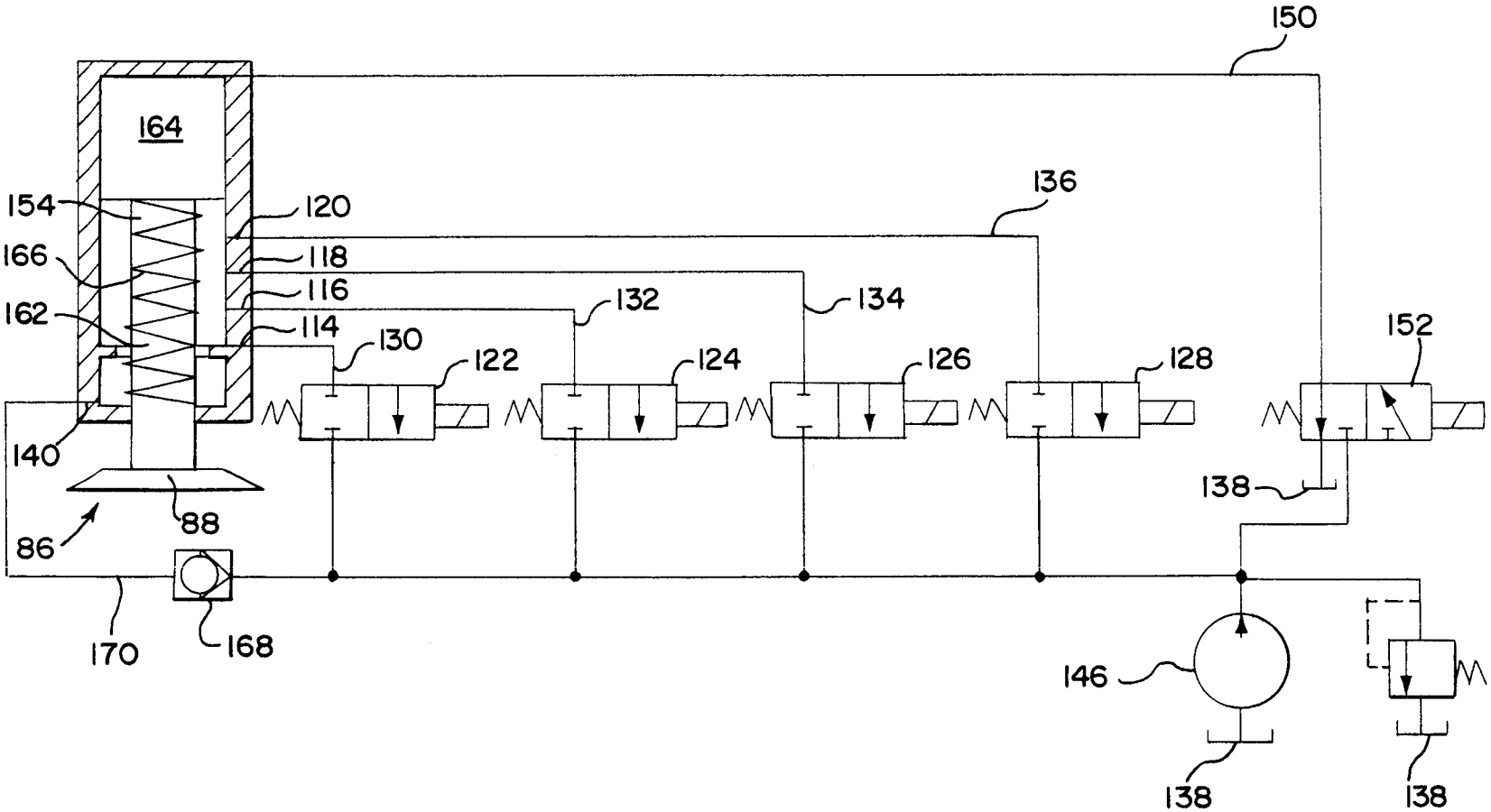
FIG. 5 is a schematic illustration of a fourth embodiment of an engine valve control system.
Figure 7:
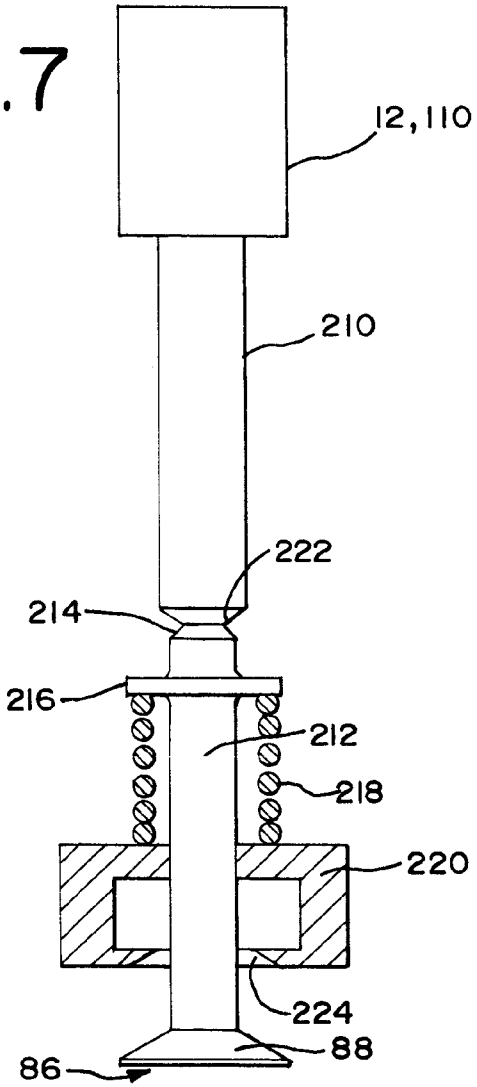
FIG. 7 is a partial cross-sectional view of an alternative embodiment of an engine valve connected to a piston.

In a fourth alternative embodiment, shown in FIG. 5, a single-cylinder hydraulic-return (SCHR) DLVT system includes a differential cylinder, with a piston 164 having a push rod 162 and a valve stem each having a substantial cross-sectional area. Again, it should be understood that the valve stem preferably has a cross-section substantially less than the cross-section area of the push rod. The push rod side of the piston 164 is always pressurized, through a one-way check valve 168, for the return function. In addition, exhaust ports 114, 116, 118 and 120 are operably connected, through exhaust lines 130, 132, 134 and 136 and electrohydraulic valves 122, 124, 126 and 128, respectively, to the pump 146, instead of the exhaust tank 138. These are the only two substantial differences from the third embodiment shown in FIG. 4. A spring 166 can also be used to assist in the return motion. The remaining components in FIG. 5 have been designated with the same reference numbers used to identify like components of the first embodiment shown in FIG. 4. As in the third embodiment, the back-filling route through the port 140, line 170 and valve 168 can be replaced by opening one or more of the valves 122, 124, 126 and 128.

Figure 6:
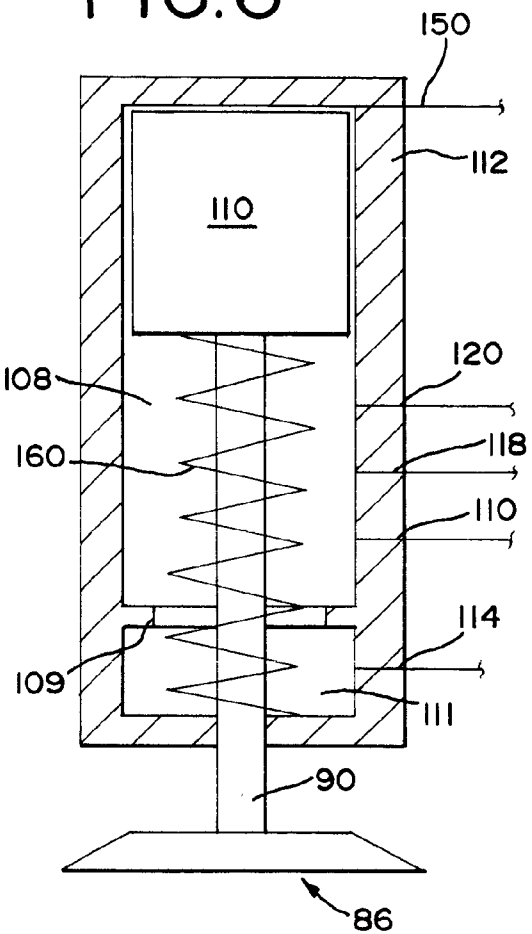
FIG. 6 is a schematic illustration of a fifth embodiment of an engine valve control system.

An alternative embodiment of a cylinder and piston arrangement is shown in FIG. 6. It should be understood that the configuration shown in FIG. 6 could be incorporated into either of the systems shown in FIGS. 4 and 5, but that, for the sake of simplicity, the various valves and pumps employed in those systems have not been shown again in FIG. 6. Referring to FIG. 6, the exhaust port 114 communicates with the cavity 111 formed below the stop 109. In this way, check valve 156 (shown in FIGS. 4 and 5) can be eliminated as the back flow is controlled through port 114 by way of operation of the valve 122 (shown in FIGS. 4 and 5) operably connected thereto.

FIGS. 7–10 shown various alternative arrangements for operably connecting the engine valve 86 with the piston 12, 110. In this context, the phrase "operably connected" means interfaced, engaged, or coupled with for at least a portion of the opening cycle, such that the movement of the piston moves the engine valve in the first direction. In the embodiment shown in FIG. 7, the push rod 210 abuttingly engages, but is not fixed to, an end 214 of the valve stem 212 so as to be operably connected thereto. The valve stem 212 includes a laterally extending flange member 216. A return spring 218 is disposed between the housing 220 and the flange member 216 and biases the engine valve upwardly against the piston push rod 210 so as to seat the engine valve. During the opening cycle, the end of the push rod 222 engages, or is operably connected to, the end 214 of the valve stem and pushes the engine valve off of the seat 224. The piston push rod and valve stem are not fixedly connected, but rather have a free-floating interface.

Figure 8:
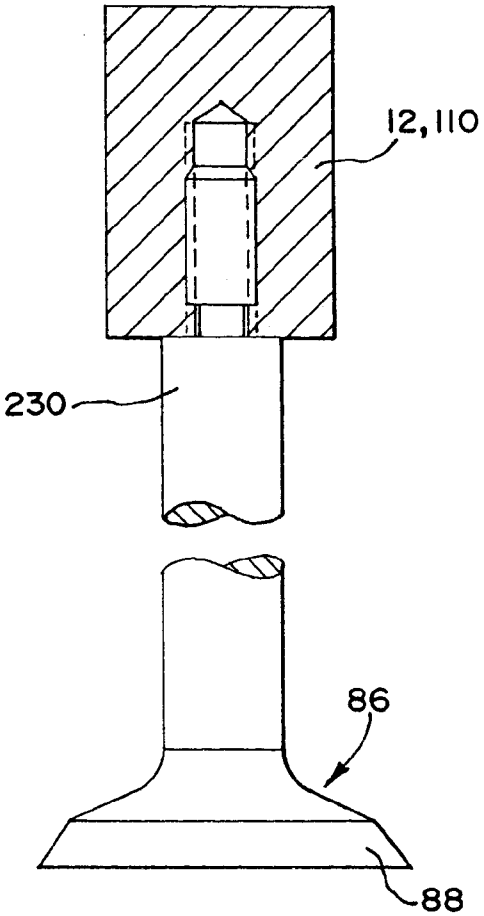
FIG. 8 is a partial cross-sectional view of an alternative embodiment of an engine valve connected to a piston.

In the embodiment shown in FIG. 8, the engine valve stem and push rod are integrally formed as a single shaft 230, with an end of the shaft preferably being threadably engaged with the piston 12, 110.

Figure 9:
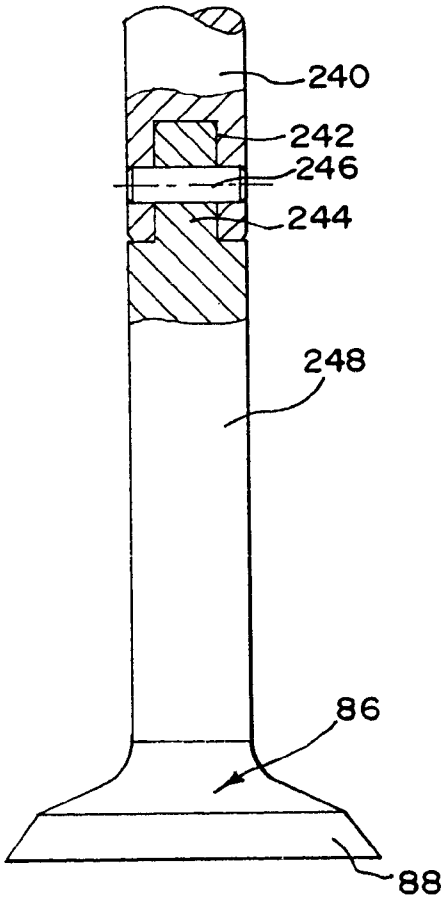
FIG. 9 is a partial cross-sectional view of an alternative embodiment of an engine valve connected to a piston.

Alternatively, as shown in FIG. 9, the push rod 240 includes an opening or recess 242 dimensioned to receive an insert portion 244 of the valve stem 248. Of course, it should be understood that the recess could be formed on the valve stem, with the insert portion formed on the push rod. A pin 246 extends through aligned openings formed in each of the push rod 240 and valve stem 248 so as to operably connect the engine valve and piston.

Figure 10:
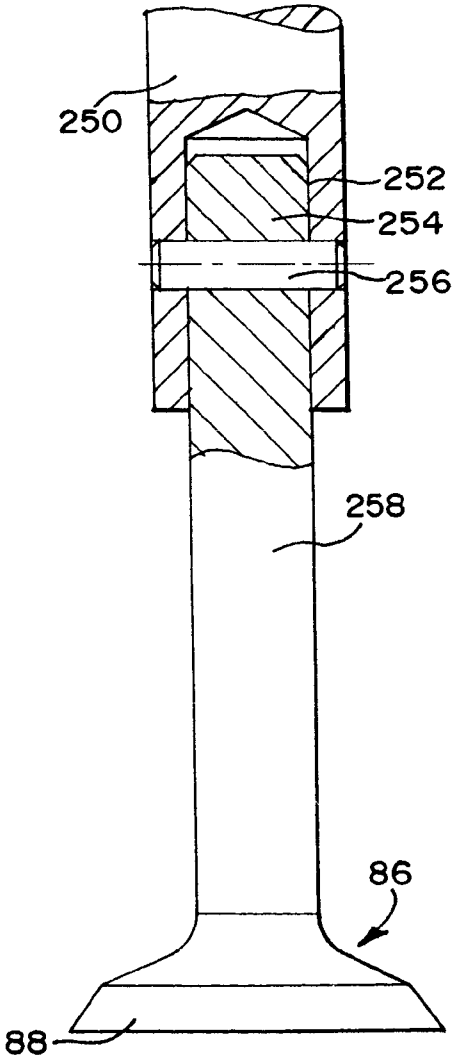
FIG. 10 is a partial cross-sectional view of an alternative embodiment of an engine valve connected to a piston.

In yet another embodiment, shown in FIG. 10, the push rod 250 has a larger diameter than the engine valve stem 258. In this embodiment, the end 254 of the valve stem is received in an opening 252, or recess, formed in the end of the push rod. Again, a pin 256 extends through aligned openings formed in the valve stem and push rod and connects the engine valve and piston. One of skill in the art will understand that other alternative embodiments of operably connecting the engine valve and piston can be used without departing from the scope or spirit of this invention, and that the preceding embodiments are meant to be illustrative rather than limiting.

In each of the DLVT system embodiments described above, the engine valve control system provides for discrete-lift and variable-timing of the engine valve. Discrete-lift is achieved by the selection of the combination of electrohydraulic valves operably connected to the corresponding selected combination of cylinders or exhaust ports. Variable-timing is achieved by solenoid activation timing control of the respective selected electrohydraulic valves as is the case in general electrohydraulic systems.

The engine valve control system does not require any lift feedback, but rather is an open loop control. The advantage is that the lift accuracy is guaranteed by the simple, robust mechanical design of the various embodiments described herein. Indeed, the various preferred DLVT systems are generally much simpler, more robust, and less expensive than conventional VVLT systems. As such, there is no need for position sensors, complex control algorithm, and complicated electronic driver circuits. At the same time, a DLVT system with preferably two or three discrete lifts (coupled with variable timing) will perform substantially the same as a VVLT system.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A valve control system for an internal combustion engine comprising:

a housing comprising a plurality of fixed, axially spaced cylinders positioned serially one on top of the other with each of said plurality of cylinders defining a stroke respectively, wherein said plurality of cylinders comprises a lowermost cylinder and at least one next upper cylinder, and wherein said stroke of said at least one next upper cylinder is less than or equal to the stroke of a next lower cylinder;

a plurality of pistons comprising a lowermost piston moveably disposed in said lowermost cylinder and at least one next upper piston moveably disposed respectively in said at least one next upper cylinder, wherein said each of said at least one next upper pistons engages a next lower piston during the stroke of said at least one next upper piston respectively;

an engine valve operably connected to said lowermost piston; and a plurality of electrohydraulic valves each operable between at least an open and closed position, wherein each of said plurality of electrohydraulic valves is operably connected to one of said plurality of cylinders and is operable independently of the other of said plurality of electrohydraulic valves, and wherein a selected combination of said plurality of electrohydraulic valves are selectively operated between at least said open and closed positions.

2. The invention of claim 1 wherein said plurality of electrohydraulic valves comprises a plurality of solenoid valves.

3. The invention of claim 1 further comprising a return mechanism engaged with and biasing said lowermost piston in an upward direction.

4. The invention of claim 3 wherein said return mechanism comprises a spring.

5. The invention of claim 3 wherein said return mechanism comprises a hydraulic flow.

6. The invention of claim 1 wherein each of said plurality of pistons comprises a head and a push rod, wherein said push rod of each of said at least one next upper piston engages the head of the next lower piston when said at least one next upper piston is moved by said corresponding electrohydraulic valve operably connected to the corresponding next upper cylinder in which said at least one next upper piston is disposed.

7. The invention of claim 1 wherein said plurality of cylinders comprises a first, second, third and fourth cylinder, with said first cylinder comprising said lowermost cylinder, wherein said plurality of pistons comprises a first, second, third and fourth piston, with said first piston comprising said lowermost piston, and wherein said plurality of electrohydraulic valves comprise a first, second, third and fourth electrohydraulic valve, wherein said stroke of said fourth cylinder is less than said stroke of said third cylinder which is less than the stroke of said second cylinder which is less than the stroke of said first cylinder.

8. The invention of claim 7 wherein said selected combination of said plurality of electrohydraulic valves comprises said first and second electrohydraulic valves.

9. A valve control system for an internal combustion engine comprising:

a housing comprising a cylinder having a longitudinal extent and a plurality of longitudinally spaced exhaust ports communicating with said cylinder;

a piston disposed in said cylinder and moveable therein along said longitudinal extent, said piston having a first and second side, wherein said exhaust ports are exposed only to one of said first and second sides;

an engine valve operably connected to said piston; and a plurality of electrohydraulic valves operable between at least an open and closed position, wherein each of said plurality of electrohydraulic valves is operably connected to one of said plurality of exhaust ports and is operable independently of the other of said plurality of electrohydraulic valves, and wherein a selected combination of said plurality of electrohydraulic valves are selectively operated between said at least said open and closed positions.

10. The invention of claim 9 wherein said plurality of electrohydraulic valves comprises a plurality of solenoid valves.

11. The invention of claim 9 further comprising a return mechanism engaged with and biasing said piston in an upward direction.

12. The invention of claim 11 wherein said return mechanism comprises a spring.

13. The invention of claim 11 wherein said return mechanism comprises a hydraulic flow.

14. The invention of claim 9 wherein said piston comprises a head and a push rod.

15. The invention of claim 9 wherein said plurality of exhaust ports comprises a first, second, third and fourth exhaust port and wherein said plurality of electrohydraulic valves comprises a first, second, third and fourth electrohydraulic valve.

16. The invention of claim 9 further comprising an inlet port communicating with said cylinder.

17. A method for controlling an engine valve in an internal combustion engine comprising:

providing a housing comprising a plurality of fixed, axially spaced cylinders positioned serially one on top of the other with each of said plurality of cylinders defining a stroke respectively, wherein said plurality of cylinders comprises a lowermost cylinder and at least one next upper cylinder, and wherein said stroke of said at least one next upper cylinder is less than or equal to the stroke of a next lower cylinder; a plurality of pistons comprising a lowermost piston moveably disposed in said lowermost cylinder and at least one next upper piston moveably disposed respectively in said at least one next upper cylinder; said engine valve operably connected to said lowermost piston disposed in said lowermost cylinder; and a plurality of electrohydraulic valves, wherein each of said plurality of electrohydraulic valves is operably connected to one of said plurality of cylinders and is operable independently of the other of said plurality of electrohydraulic valves;

activating a selected combination of said plurality of electrohydraulic valves;

moving a selected combination of said plurality of pistons in a first direction through a plurality of corresponding strokes within said plurality of cylinders in response to said activating said selected combination of electrohydraulic valves, wherein said selected combination of said plurality of pistons comprises an uppermost piston;

engaging a next lower piston with said each of said at least one next upper pistons during the stroke of said at least one next upper piston respectively;

disengaging said next lower piston from said each of said at least one next upper pistons as said stroke of said at least one next upper piston is completed; and moving said engine valve in said first direction in response to said moving said selected combination of said plurality of pistons in said first direction.

18. The invention of claim 17 wherein said moving said engine valve in said first direction comprises decelerating said engine valve as each of said plurality of pistons within said selected combination of said plurality of pistons reaches the end of its respective stroke.

19. The invention of claim 17 further comprising deactivating said selected combination of said plurality of said electrohydraulic valves, applying a return force to said lowermost piston, moving said lowermost piston in a second direction in response to said return force, and moving said valve with said lowermost piston in said second direction.

20. The invention of claim 19 further comprising successively engaging said at least one next upper piston with said next lower piston and moving said selected combination of said plurality of pistons in said second direction through their corresponding strokes respectively.

21. The invention of claim 20 wherein said moving said engine valve in said second direction comprises decelerating said engine valve as each of said next upper pistons within said selected combination of said plurality of pistons is engaged with said next lower piston respectively.

22. The invention of claim 17 wherein said selected combination of said plurality of electrohydraulic valves and said selected combination of said plurality of pistons comprises said entire plurality of said electrohydraulic valves and said entire plurality of pistons respectively.

23. The invention of claim 17 wherein said selected combination of said plurality of electrohydraulic valves and said selected combination of said plurality of pistons are less than said plurality of said electrohydraulic valves and said plurality of pistons respectively.

24. A method for controlling an engine valve in an internal combustion engine comprising:

providing a housing comprising a cylinder having a longitudinal extent and a plurality of longitudinally spaced exhaust ports communicating with said cylinder; a piston disposed in said cylinder and moveable therein along said longitudinal extent, said piston having a first and second side, wherein said exhaust ports are exposed only to one of said first and second sides; said engine valve operably connected to said piston; a plurality of electrohydraulic valves, wherein each of said plurality of electrohydraulic valves is operably connected to one of said plurality of exhaust ports and is operable independently of the other of said plurality of electrohydraulic valves;

activating a selected combination of said plurality of electrohydraulic valves and opening a selected combination of said plurality of exhaust ports;

moving said piston in a first direction;

successively covering said selected combination of said plurality of exhaust valves with said piston as said piston moves in said first direction; and moving said engine valve in said first direction in response to said moving said piston in said first direction.

25. The invention of claim 24 wherein said moving said engine valve in said first direction comprises decelerating said engine valve as each of said plurality of exhaust ports within said selected combination of said plurality of exhaust ports is covered by said piston.

26. The invention of claim 24 wherein said selected combination of said plurality of exhaust ports comprises a lowermost exhaust port and further comprising stopping said engine valve as said lowermost exhaust port is covered by said piston.

27. The invention of claim 24 further comprising applying a return force to said piston, moving said piston in a second direction in response to said return force, and moving said engine valve with said piston in said second direction.

28. A method for controlling an engine valve in an internal combustion engine comprising:

providing a housing comprising a cylinder having a longitudinal extent and a plurality of longitudinally spaced exhaust ports communicating with said cylinder; a piston disposed in said cylinder and moveable therein along said longitudinal extent; said engine valve operably connected to said piston; a plurality of electrohydraulic valves, wherein each of said plurality of electrohydraulic valves is operably connected to one of said plurality of exhaust ports and is operable independently of the other of said plurality of electrohydraulic valves;

activating a selected combination of said plurality of electrohydraulic valves and opening a selected combination of said plurality of exhaust ports, wherein said selected combination of said plurality of electrohydraulic valves and said selected combination of said plurality of exhaust ports comprises said entire plurality of said electrohydraulic valves and said entire plurality of exhaust ports;

moving said piston in a first direction;

successively covering said selected combination of said plurality of exhaust valves with said piston as said piston moves in said first direction; and moving said engine valve in said first direction in response to said moving said piston in said first direction.

29. The invention of claim 24 wherein said selected combination of said plurality of electrohydraulic valves and said selected combination of said plurality of exhaust ports are less than said plurality of said electrohydraulic valves and said plurality of exhaust ports respectively.

30. The invention of claim 24 further comprising providing an inlet port communicating with said cylinder and wherein said moving said piston comprises flowing a fluid into said cylinder through said inlet port.

31. A method for controlling an engine valve in an internal combustion engine comprising:

providing a housing comprising a cylinder having a longitudinal extent, a plurality of longitudinally spaced exhaust ports communicating with said cylinder and an inlet port communicating said cylinder; a piston disposed in said cylinder and moveable therein along said longitudinal extent; said engine valve operably connected to said piston; a plurality of electrohydraulic valves, wherein each of said plurality of electrohydraulic valves is operably connected to one of said plurality of exhaust ports and is operable independently of the other of said plurality of electrohydraulic valves; and an inlet valve operably connected to said inlet port;

activating a selected combination of said plurality of electrohydraulic valves and opening a selected combination of said plurality of exhaust ports;

flowing a fluid into said cylinder through said inlet port and thereby moving said piston in a first direction, wherein said flowing said fluid comprises opening said inlet valve;

successively covering said selected combination of said plurality of exhaust valves with said piston as said piston moves in said first direction; and moving said engine valve in said first direction in response to said moving said piston in said first direction.

32. A valve control system for an internal combustion engine comprising:

a housing comprising a cylinder having a longitudinal extent, a plurality of longitudinally spaced exhaust ports communicating with said cylinder and an inlet port communicating with said cylinder;

a piston disposed in said cylinder and moveable therein along said longitudinal extent;

an engine valve operably connected to said piston;

a plurality of electrohydraulic valves operable between at least an open and closed position, wherein each of said plurality of electrohydraulic valves is operably connected to one of said plurality of exhaust ports and is operable independently of the other of said plurality of electrohydraulic valves, and wherein a selected combination of said plurality of electrohydraulic valves are selectively operated between said at least said open and closed positions; and an inlet valve operable between at least an open and closed position, wherein said inlet valve is operably connected to said inlet port and is operated between said at least said open and closed positions.

* * * * *